US007213684B2

(12) United States Patent
Bruns et al.

(10) Patent No.: US 7,213,684 B2
(45) Date of Patent: May 8, 2007

(54) DEVICE FOR HOLDING A LOAD ON A LOAD SUPPORT OF AN INDUSTRIAL TRUCK

(75) Inventors: Rainer Bruns, Hamburg (DE); Stefan Steiger, Frankisch-Grumbach (DE); Jan-Henning Wille, Munich (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 11/138,021

(22) Filed: May 26, 2005

(65) Prior Publication Data

US 2005/0279582 A1 Dec. 22, 2005

(30) Foreign Application Priority Data

Jun. 4, 2004 (DE) ..... 10 2004 027 445

(51) Int. Cl.
*B66F 9/12* (2006.01)

(52) U.S. Cl. ..... 187/237; 187/238; 414/462; 414/466; 414/607

(58) Field of Classification Search ..... 187/237; 414/462, 466, 607, 619, 622
See application file for complete search history.

(56) References Cited

U.S. PATENT DOCUMENTS

| | | | | |
|---|---|---|---|---|
| 2,566,863 | A * | 9/1951 | Voigt | 414/622 |
| 2,682,347 | A * | 6/1954 | Jackson | 414/741 |
| 2,807,382 | A * | 9/1957 | Schenkelberger | 414/620 |
| 2,900,098 | A * | 8/1959 | Forrest et al. | 414/618 |
| 3,024,929 | A * | 3/1962 | Shimmon | 414/420 |
| 4,273,499 | A * | 6/1981 | Berko | 414/626 |
| 4,734,979 | A * | 4/1988 | Sakamoto et al. | 29/822 |
| 4,927,320 | A * | 5/1990 | Olson | 414/814 |
| 4,936,560 | A * | 6/1990 | Barozzi | 269/266 |
| 5,026,245 | A * | 6/1991 | Sabo | 414/622 |
| 5,509,774 | A * | 4/1996 | Yoo | 414/622 |
| 5,984,293 | A * | 11/1999 | Abrahamson et al. | 269/266 |
| 6,298,587 | B1 * | 10/2001 | Vollom | 40/427 |
| 6,695,298 | B1 * | 2/2004 | Hertz et al. | 269/266 |
| 6,918,733 | B2 * | 7/2005 | Neuber et al. | 414/426 |
| 2006/0047363 | A1 * | 3/2006 | Farrelly et al. | 700/245 |

FOREIGN PATENT DOCUMENTS

| | | |
|---|---|---|
| DE | 41 29 89 | 4/1925 |
| DE | 28 23 584 C2 | 1/1983 |
| DE | 33 12 609 | 10/1984 |
| DE | 29 29 621 C2 | 1/1987 |
| DE | 38 12 155 A1 | 3/1988 |
| DE | 0 467 210 A1 | 7/1991 |
| DE | 94 18 354 | 1/1995 |
| GB | 2 250 267 | 6/1992 |
| WO | 02/14206 | 2/2002 |

* cited by examiner

*Primary Examiner*—Gene O. Crawford
*Assistant Examiner*—Terrell Matthews
(74) *Attorney, Agent, or Firm*—Vidaś, Arrett & Steinkraus, P.A.

(57) ABSTRACT

Device for holding a load on a load support of an industrial truck with the following characteristics:

a support construction, adjustable in its height by a lifting drive, is mounted above the load support the support construction has several vertical guidances, distributed across a plane, in each of which one plunger (8) is vertically guided a clamping device is attached on the support construction, by means of which the plungers are fixable in the guidances in an arbitrary height position, and an actuation device for the clamping device for optional clamping or releasing the plungers in their guidances.

21 Claims, 5 Drawing Sheets

DEVICE FOR HOLDING A LOAD ON A LOAD SUPPORT OF AN INDUSTRIAL TRUCK

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Fork lifters, shovel loaders or the like industrial trucks have a load support for taking up, transporting and setting down of a load. Mostly, the transporting object is disposed on pallets, which on their part can be transported with the load fork of an industrial truck, e.g.

Transporting objects having a high centre of gravity or a low weight at a small area of standing up may fall down from the pallet or the load support, respectively, particularly when the industrial truck drives over uneven ground or through curves. For this reason, it is known since a long time to use so-called load holders, which exert a push from the upside onto the transporting object, in order to prevent any falling down from the pallet or of the pallet from the load support. From DE 9418354 U1 or EP 467210 B1 a holding device has become known, in which a horizontal plate is height-adjustably arranged and can be pushed onto the transporting object by vertical lowering. When there are several transporting objects of different height on the pallet, or when there are several pallets with transporting objects of different heights on the load support, any sufficient fixing of the transporting object is not possible.

This is the reason why it has become known from DE 412989 C or WO 214206 A2 to mount several load holders side by side on one support device. Through this, it is possible to clamp fast several transporting objects of different height, which are situated side by side on the load support. However, it is not possible to sufficiently clamp fast transporting objects of different height which are situated in the fork direction with respect to each other.

From GB 2250267 A, DE 2929621 C2 it is known to make several plates individually height-adjustable, which are arranged side by side or back to back. It is a disadvantage of this solution that the height differences between the individual transporting objects have to be in narrow limits.

This invention is based on the objective to provide a device for holding a load on a load support of an industrial truck in which the transporting objects can differ significantly in their heights.

BRIEF SUMMARY OF THE INVENTION

In the device according to the invention, a support construction, adjustable in its height, is mounted above the load support on the industrial truck. With the aid of a lifting drive, the support construction can be shifted in its height. Across a plane, which approximately corresponds to the area of a pallet, for instance, it has several vertical guidances, in which plungers are vertically guided. When the plungers are not fastened, they can find support on the respective transporting object which is situated there under. If it is taken care that after this process the plungers remain in this position, a secure fixing of the transporting object is achieved. Therefore this invention further provides a clamping device, by which the plungers can be clamped fast in the guidances on arbitrary height positions. An actuation device provides for optional clamping or releasing of the plungers in the guidances.

In the invention, a greater number of plungers which are arranged in a field corresponding about to the extension of the load, and which can be lowered onto a load in such a manner that they reproduce the discontinuous surface contour of the load, provides for sufficient securing of the transporting object on the load support. All the plungers are in contact with the load and can be vertically fixed. Through this, securing of the load is provided, particularly against canting over.

Several possibilities of construction can be conceived to realise the described teachings. One form of realisation of the invention provides for this purpose that the support construction is guided in a lifting scaffold of the industrial truck and that it is driven by a lifting cylinder, a chain drive or the like. The lifting scaffold can be realised in a manner comparable to the lifting scaffold of a fork lifter. For lifting or lowering, a double-acting lifting cylinder can be provided, which is operated hydraulically or pneumatically. However, a single-acting lifting cylinder may also be provided, a braking device being necessary in this case in addition which is switched on when needed in order to fix the support construction in an arbitrary position. However, a mechanical lifting device like a spindle or chain drive, for instance, may also be provided instead of a lifting cylinder.

It is known to provide a high-lift truck with two load supports for a double-deck loading. In this, the lower load support is rigidly fixed on the lifting scaffold of the high-lift truck. By lifting the entire lifting apparatus, the transporting object can be lifted. A load sledge is guided on the lifting apparatus, on which the upper load support is fixed. In such a construction, the upper load sledge can be replaced by the support construction according to the invention, or it can be mounted on the upper load sledge.

Several realisations can be conceived for the support construction. For instance, it can have a support plate, which is provided with bores in which the plungers are accommodated. The support plate can be made of plastic material or of a composite material, for instance. Alternatively, a welding construction can be produced from standard profiles, in which case sleeves are provided instead of the bores, in which the plungers are vertically guided.

According to a further form of realisation of this invention, the plungers have a stop on the ends, which prevents any slipping of the plungers towards the downside. For instance, enlargements of the plungers on its upper ends can serve for this purpose. The plungers, which are preferably circle-shaped in section, as well as the bores assigned thereto, can be realised as pipes or also in a massive manner.

In a further form of realisation of this invention, it is provided that a clamping unit, which can be actuated by the actuation device, is horizontally guided between a release position and a clamping position on the support construction. The clamping unit has clamping means, which can be brought into clamping or frictional lateral engagement, respectively, with the plungers in the clamping position. The clamping unit, which is preferably linearly guided by the support construction, can be actuated with the aid of one single actuation cylinder, for instance, in order to bring the clamping unit optionally into the release position or the clamping position. Instead of a double-acting actuation cylinder, a single-acting one can also be conceived, a pretension spring acting in the opposite direction, preferably in the clamping direction.

Preferably, the clamping means are frictional elements or the like, which can be brought into non-positive engagement with the shafts of the plungers. Thus, an elastic ribbon can be conceived as a frictional element, for instance, which is disposed horizontally and which partly non-positively loops around the respective plunger, when the frictional unit is in it's the clamping position.

According to a further form of realisation of the invention, the clamping unit can be formed by a frame construction, which is linearly horizontally guided in the support construction. The frame construction can have several parallel spaced apart U-profiles, the bridge of which has long holes through which plungers are guided through, and the clamping means are assigned to those long holes which are made on the limbs of the U-profiles, in the form of the already mentioned elastic ribbons, e.g.

According to a further form of realisation of the invention, the actuation of the lifting drive and the actuation device are controlled by a controlling device. In order to do this, a further form of realisation provides that the controlling device controls the clamping device into the release position when the support construction is moved and that it controls it into the clamping position when the support construction is in the idle condition. By doing so, the actuation of the holding device is performed widely automatically.

A further form of realisation of the invention enables control of the holding device which is even better coordinated with respect to time, according to which first sensors are assigned to the plungers, which determine whether a plunger has been shifted towards the upside about a maximum path with respect to the support construction. The controlling device stops the lowering movement of the support construction, when it receives a first sensor signal. In this case, the support construction can not be lowered further, because it would otherwise damage the object to be transported. However, at very large height differences, not all the plungers are in engagement yet in this condition. Thus, the sensor signal indicates the later and possible moment of switching off, but not imperatively the time-optimised one.

According to the invention, a further possibility of control results when second sensors, connected to the controlling device, are provided on the support construction, which emit a second sensor signal when a plunger reaches a maximum lower position. The controlling device stops the lowering movement of the support construction, when all the plungers are lifted with respect to the undermost position. This sensor set-up serves to stop the lowering movement at the earliest moment as is possible. Thus, it serves for time-saving.

For instance, the sensors can be realised in that electric contacts are provided on the support construction, which co-operate with contact surfaces on the plungers. Preferably, the lower end of the plungers is enlarged, in order to have better securing and to prevent damage of the transporting object. In every case, it is advantageous when the bottom end surfaces of the plungers have a coating or the like with a high frictional value.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated FIG. 1 shows the side view of an industrial truck with a device according to the invention.

Figure 6:
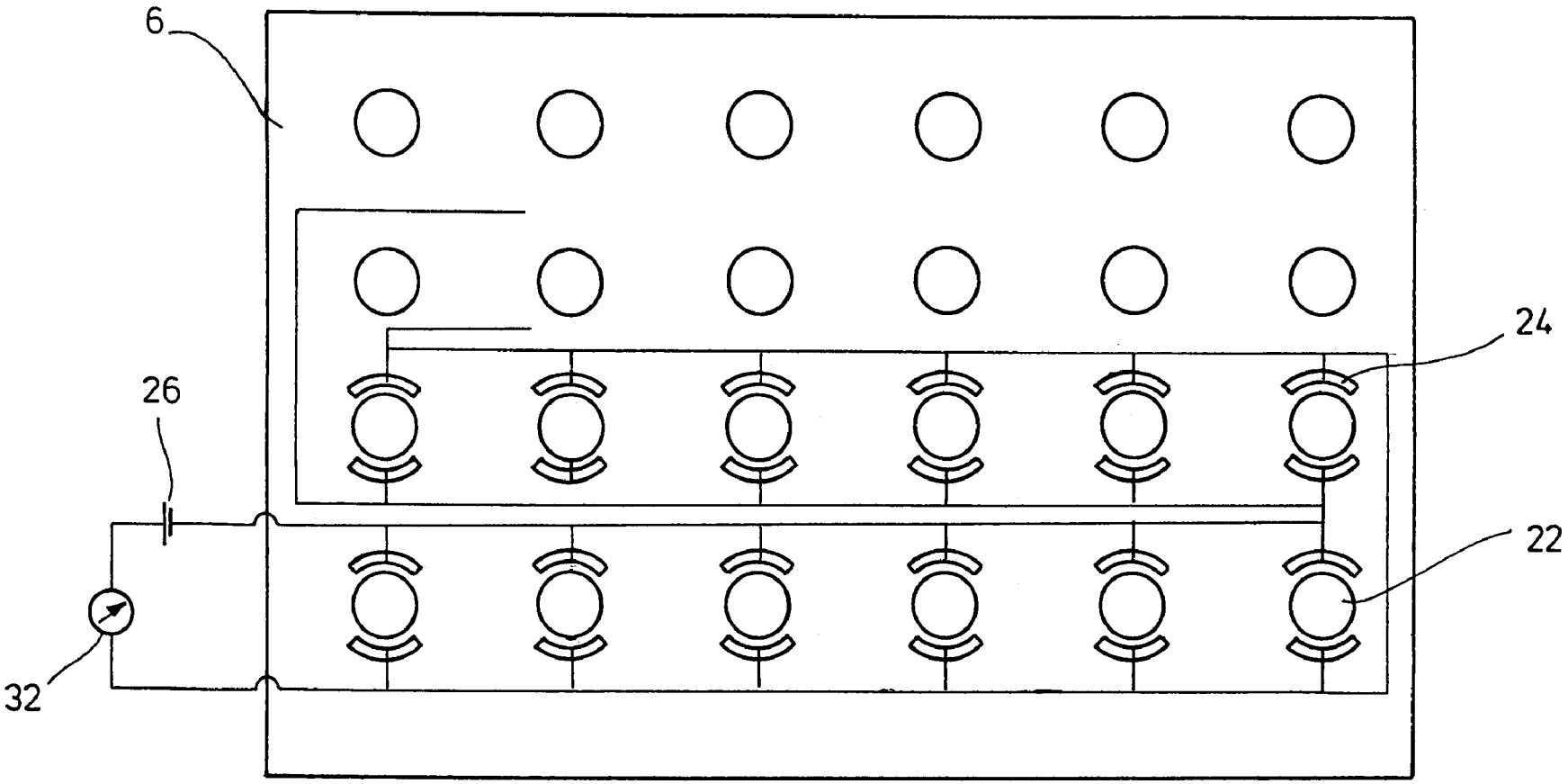

FIG. 6 schematically shows the bottom side of the support plate according to the device of invention.

Figure 1:
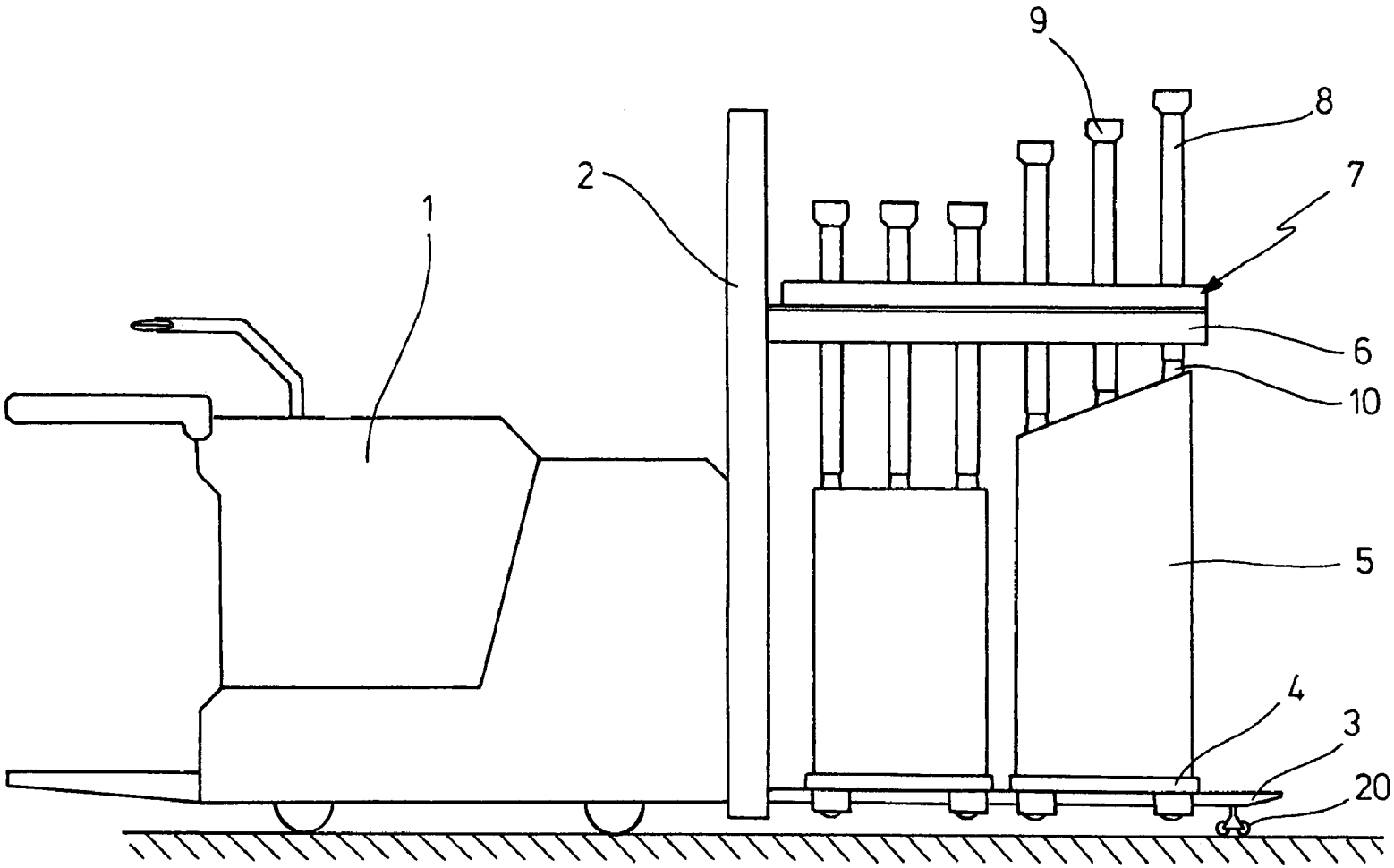
Figure 2:
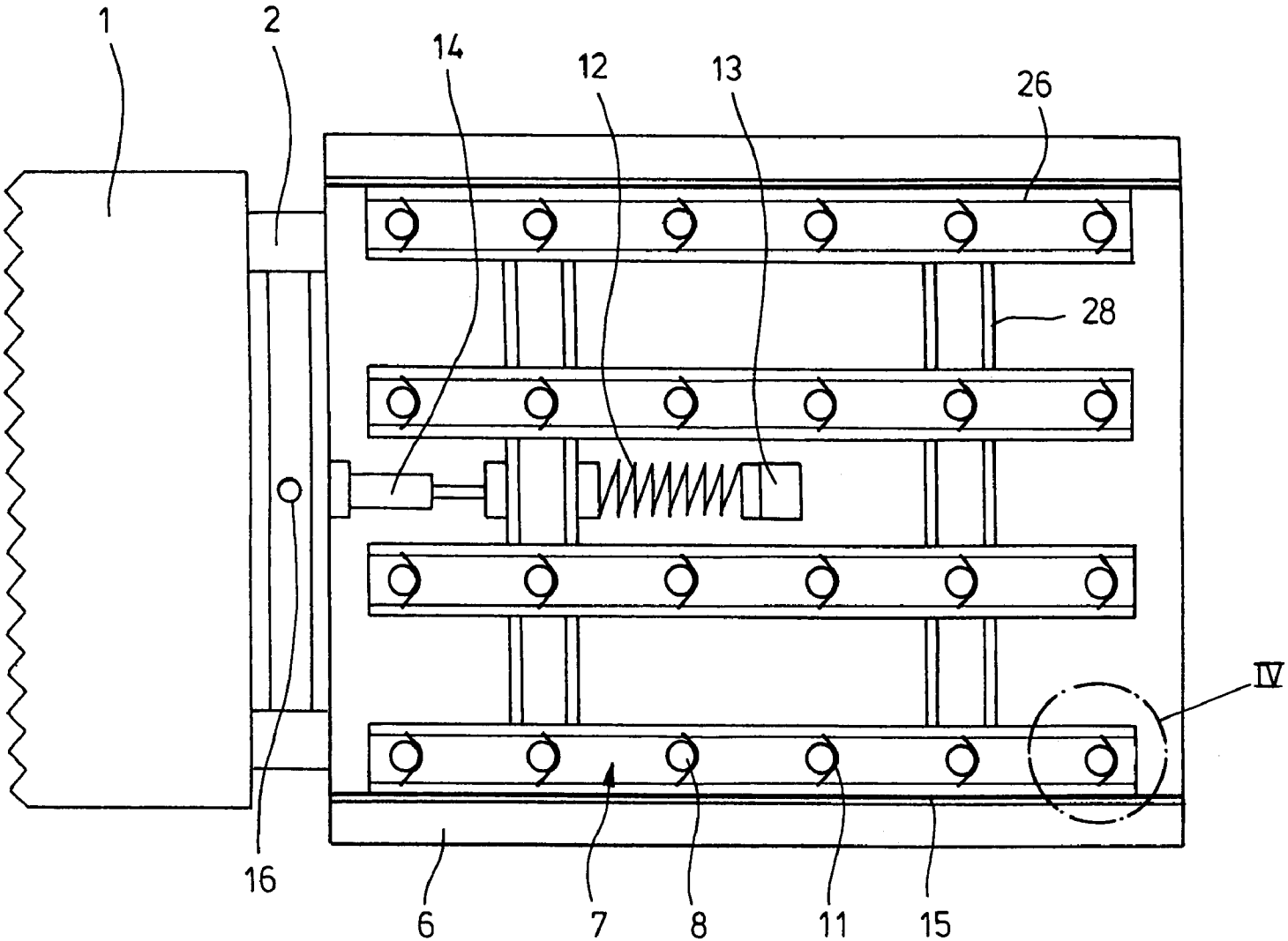
FIG. 2 shows the top view of the representation after FIG. 1.
Figure 3:
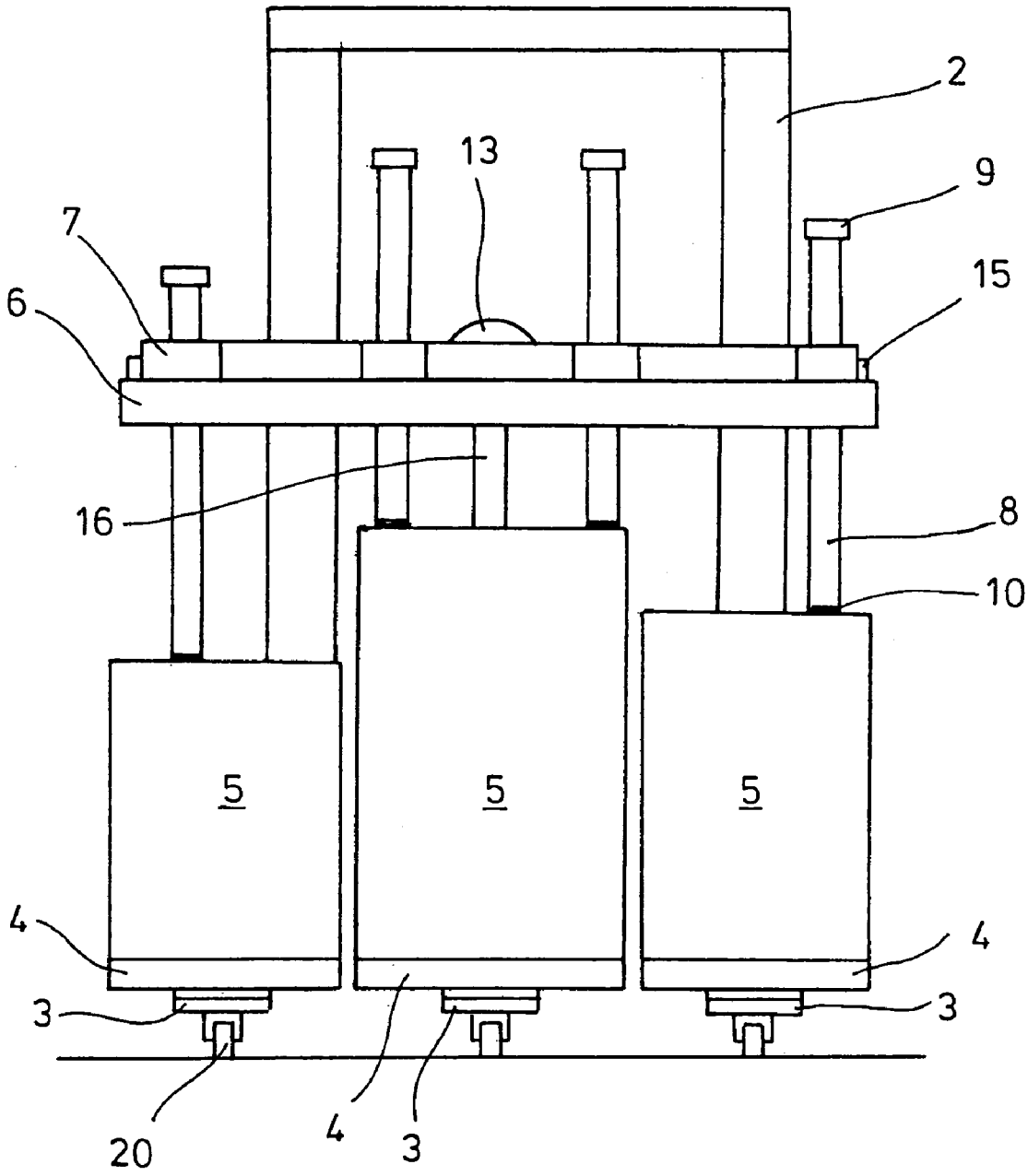
FIG. 3 shows the front view of the industrial truck after FIG. 1 with the device according to the invention.

In the FIGS. 1 to 3, an electric drawbar lifting truck 1 can be recognised, with a fork support, having three fork tines 3 (see FIG. 3), which are provided with sustaining rolls 20 on the front side, with respect to which the tines 3 can be hydraulically lifted, as is per se commonly known. As can be recognised, several rolling pallets 4 are received in series in the longitudinal direction on the fork tines 3.

A lifting scaffold 2 is attached on the lifting truck 1, on which a support plate 6 is guided to be vertically movable. A double-acting lifting cylinder 16 effects the lifting and lowering movements of the support plate 6 (FIGS. 2 and 3). Other mechanical lifting devices can be conceived instead of a pneumatic or hydraulic lifting cylinder, a spindle or chain drive, for instance. The lifting cylinder can also be single-acting, a brake device being necessary in this case, which is applied thereto in order to fix the support plate in its respective position. As the case may be, a brake device can be omitted, provided that the load holding device has sufficiently high own weight.

The support plate 6 is shown as a massive plate, which is made from plastic material or a composite material. Instead of a massive plate, a welded construction from standard profiles can also be provided.

In the support plate 6 there are bores 22, in which the plungers 8 can move vertically. As emerges from FIG. 6, contact elements 24 are situated on the bottom side of the support plate 6 on opposing sides of the bores, which are not drawn for all the bores, however. They are in connection with a battery 26. All the contact element couples 24 are connected in series.

In the represented realisation example, 4×6 bores 22 are disposed in uniform distances from each other, which corresponds to a field that can be occupied by the load support or the transporting objects which can be received on the load support, respectively. Thus, 24 plungers 8 are provided. The thickness of the support plate 6 is sufficient to assure an unobjectionable guiding in the bores 22. It is also conceivable to use additional sleeves or, at welding constructions, sleeves only for guiding, in order to assure friction-free guiding of the plungers 8.

On the support plate 6 a clamping unit 7 is set, which is realised as a frame construction with four parallel spaced apart U-profiles 26, which are welded together by two transversely running U-profiles 28. On the plate 6 there are two parallel ridges 15, through which the clamping unit 7 is linearly guided along the axis of the industrial truck. An actuation cylinder 14 is linked to the support plate 6, which engages with its piston rod on a cross strut 28. On the side opposite to the cylinder 14, a spring 12 is disposed, which supports itself on the plate 6 on the cross profile 28 on the one hand, and on an abutment 13 on the other hand. Instead of the spring 12, the actuating cylinder 14 can also be a double-acting one.

Figure 4:
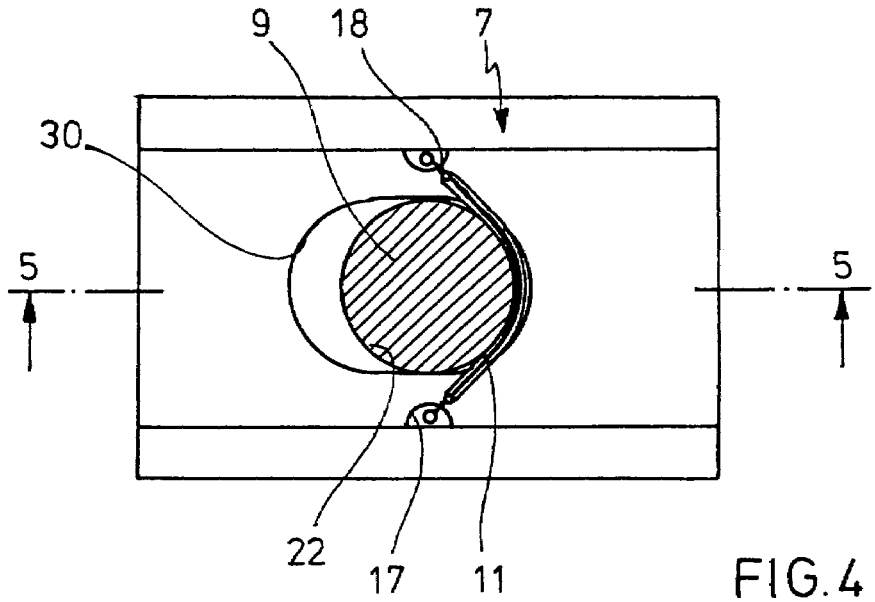
FIG. 4 shows detail 4 in FIG. 2.
Figure 5:
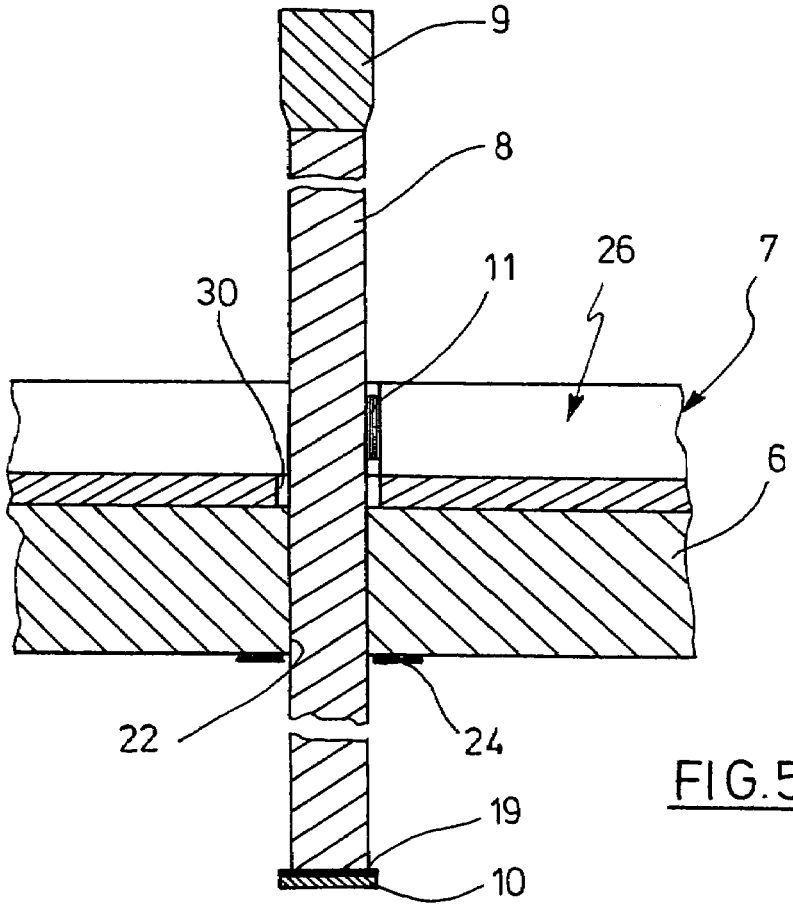
FIG. 5 shows a section through the representation after FIG. 4 along the line 5—5.

As emerges from FIGS. 4 and 5, the bridges of the U-profiles 26 have long holes 30, which are aligned with the bores 22 of the support plate 6. The plungers 8 are also guided through the long holes 30. In the region of the long holes 30, a bow-like mounting 17 is disposed on an inner side of the limbs of the U-profiles 7 for each elastic ribbon 18 at a time. When the plunger 8 is in the position shown in FIG. 4, it is partially looped by the elastic ribbon 11.

In FIG. 5, a contact element couple 24 can also be recognised. On the bottom end of the plunger 8 is attached a frictional laying-on device 10 having a larger diameter, and an electrically conductive material 19 between the frictional laying-on device 10 and the plunger 8. When the plunger 8 is maximally moved upward, the conductive material 19 comes into engagement with the contact element couple 24.

The device represented in FIG. 1 to 6 works as follows. The transport of loads with the aid of the lifting truck is separated into three partial functions:

1. Setting the shown load holding device onto a load on the point of gathering of the load
2. Holding the load holding device on the load during the transport
3. Lifting off the load holding device on the point of setting down the load.

On that point where the rolling pallets 4 with load 5 situated thereon are to be gathered, the operator drives the lifting truck 1 with the fork tines 3 under six rolling pallets 4 which are stored on the floor in block storage. The fork tines 3 are in their undermost position. The support plate 6 with the clamping unit 7 is in the uppermost position, in which all the plungers 8 sit closely to the bridges of the U-profiles 26 with their enlargement 9. The plungers 8 project out of the support plate 6 towards the downside with their maximally disposable length.

4. When a lifting truck is used for double deck loading, the course of the functions should be as follows:

a) The operator drives under the rolling pallets with the forks
b) Pretensioning device is released
c) Support plate is lowered
d) Plungers come into engagement and are tensioned again
e) The lower forks with the rolling pallets are lifted, together with the lifting scaffold and the support plate.

This order ensures that canting down does not occur at the lifting of the pallets already.

When the operator actuates the lifting device for the fork tines 3, the rolling pallets 4 are lifted from the floor and lay on the fork tines 3. At the same time, the single-acting hydraulic cylinder 14 is actuated and shifts the clamping unit 7 away from the lifting truck 1, against the force of spring 12. Through this, the elastic ribbons 11 move away from the plungers 8 and the plungers 8 can freely move vertically. At the same time, the double-acting hydraulic cylinder 16 moves downward the support plate 6 in the lifting scaffold 2. The simultaneity of the three described processes is realized by means of a not shown control device, which can be realized such that no manual operating processes have to be executed by the operator.

By the lowering of the support plate 6, the plungers 8 come to lie on the upper side of the load 5 with their frictional laying-on devices 10. As the plungers are freely movable in the bores 22 and 30, they push themselves upward through the support plate. The deeper the support plate 6 is lowered, the more plungers come to lay on the different height levels of the load 5.

The described lowering process of the support plate 6 has to be ended automatically, when at least one of the plungers 8 has been pushed maximally upward through the bore 22. Then, the metal lay-on device 19 comes into contact with the contact element couple 24. As emerges from FIG. 6, an electric current is caused by this, which can be displayed in the instrument 32, for instance, and which can be used to stop the actuation of the lifting cylinder 16. When a double-acting lifting cylinder is used for the support plate 6, a pressure limiting valve (not shown) is preferably to be provided for the downward movement, in order to avoid any injury of persons or damage of the load.

In addition to the described stopping of the lowering process, which designates the latest possible moment, time saving can be achieved by introducing a second condition. As soon as all the plungers 8 have come to lie on the load 8, their enlargements 9 are released from the clamping unit 7, because the plungers 8 begin to push themselves through the bores 22 and 30. This can be sensed according to the same principle as has been described for the contact element couples 24 and the contact layer 19. Thus, contact surfaces can be provided on the lower side of the enlargement 9, which co-operate with (not shown) upper contact couples on the bridges of the U-profiles 26. The lowering movement of the support plate 6 is stopped, when the contact between these contact couples and the contact surfaces is interrupted for all the plungers.

When the lowering movement of the support plate 6 is ended, the tension of the actuation cylinder 14 is released by the controlling device. Through this, the spring 12 pushes the clamping unit 7 into the direction of the lifting truck, which has the effect that the elastic ribbons 11 are pressed against the plungers 8. Through this, a frictional engagement between plungers and elastic ribbon 11 is generated, which inhibits a vertical movement of the plungers 8. Therefore, the plunger 8 lies on the load 5 with its frictional laying-on device 10 and is fixed in its vertical movement. Because plungers 8 lay on the entire height contour of the load 5, which are not vertically movable, the load is form-locking assured against canting and through frictional engagement against slipping by the frictional laying-on device 10.

When arrived at the point of setting down, the operator actuates the lowering movement for the fork tines 3. By doing so, the rolling pallets 4 are set on the floor. At the same time, the following two processes are performed by the controlling device described above:

The actuation cylinder 14 is pressurised, so that the clamping unit 7 is pushed in the direction of the fork tines against the force of the spring 17. Through this, the tension is released from the elastic ribbons 11 and the frictional engagement for the plungers 8 is released. Thus, the plungers are freely movable in their guidances again.

On the other hand, the double-acting lifting cylinder 16 moves upward the support plate 6. As the plungers 8 are vertically freely movable, they slip through the bores 22 onto the clamping unit 7 up to their enlargement 9. When the double-acting lifting cylinder 16 has reached its uppermost position, the tension is released from the actuation cylinder 14 and the plungers 8 are tensioned again with the aid of the elastic ribbons 11.

In this position, the load is no more fixed, and the operator can drive back with the industrial truck.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Device for holding a load on a load support of an industrial truck with the following characteristics:

a support construction, adjustable in its height by a lifting drive, is mounted above the load support the support construction has several vertical guidances, distributed across a plane, in each of which one plunger (8) is vertically guided a clamping device is attached on the support construction, by means of which the plungers (8) are fixable in the guidances in an arbitrary height position, and an actuation device for the clamping device for optional clamping or releasing the plungers (8) in their guidances.

2. Device according to claim 1, characterised in that the support construction is guided in a lifting scaffold (2) of the industrial truck (1) and is driven by one lifting device selected from the list consisting of: a lifting plunger (8), and a chain drive.

3. Device according to claim 1, characterised in that the vertical guidances are formed by sleeves or bores (22) in the support construction.

4. Device according to claim 3, characterised in that the support construction has a support plate (6).

5. Device according to claim 1, characterised in that the plungers (8) have a stop on the upper ends, which prevents any slipping of the plungers (8) towards the downside.

6. Device according to claim 1, characterised in that a clamping unit, operable by the actuation device, movable in a limited path between a release position and a clamping position, is horizontally guided on the support construction and that the clamping unit has clamping means which in the clamping position can be brought into clamping or frictional lateral engagement, respectively, with the plungers (8).

7. Device according to claim 1, characterised in that the actuation device has an actuation cylinder (14).

8. Device according to claim 6, characterised in that the actuation cylinder (14) is single-acting and a pretension spring (12) preloads the clamping unit into the clamping position.

9. Device according to claim 6, characterised in that the clamping means is a frictional element.

10. Device according to claim 9, characterised in that the clamping or frictional element is an elastic, horizontally arranged ribbon (11), which partly non-positively loops around the respective plunger (8) in the clamping position.

11. Device according to claim 6, characterised in that the clamping unit is a frame construction, which is linearly horizontally guided on the support construction.

12. Device according to claim 11, characterised in that the clamping unit has several parallel spaced apart U-profiles (26), the bridge of which has long holes (30) through which plungers (8) are guided through, and the clamping means are assigned to those long holes (30) which are made on the limbs of the U-profiles (26).

13. Device according to claim 1, characterised in that the lifting drive and the actuation device are controlled by a controlling device.

14. Device according to claim 13, characterised in that the controlling device controls the clamping device into the release position when the support construction is moved and that it controls into the clamping position when the support construction is in the idle condition.

15. Device according to claim 13, characterised in that first sensors are assigned to the plungers (8), which determine whether a plunger (8) has been shifted towards the upside about a predetermined path with respect to the support construction, an that the controlling device stops the lowering movement of the support construction, when it receives a first sensor signal.

16. Device according to claim 15, characterised in that contacts (24), connected to the controlling device, are attached on the support construction, which co-operate with a contact surface (19) on the bottom end of the plungers (8).

17. Device according to claim 13, characterised in that second sensors, connected to the controlling device, are provided on the support construction, which emit a second sensor signal when a plunger (8) reaches a predetermined lower position and that the controlling device stops the lowering movement of the support construction, when all the plungers (8) are lifted with respect to the undermost position.

18. Device according to claim 17, characterised in that second contact elements, connected to the controlling device, are provided on the support construction, an that second contact surfaces are provided on the upper end of the plungers (8), which co-operate with the second contact elements when the plungers are in the lower position.

19. Device according to claim 1, characterised in that the plungers (8) have an enlargement (9) on the upper end.

20. Device according to claim 1, characterised in that disks (10) are mounted on the lower end of the plungers (8), the bottom sides of which have a high frictional value.

21. A device for holding a load on an industrial truck comprising:

a load support;

a support construction;

a clamping device; and an actuation device; wherein:

the support construction is mounted above the load support and has a height capable of being adjusted by a lifting drive, the support construction has at least one vertically guided plunger, at least one of the vertically guided plungers has an upper end along which is a stop, the stop preventing any downward slipping of the plunger, the clamping device is attached to the support construction in such a manner that the plungers are fixable by the clamping device in an arbitrary height position, the actuation device allows for optional clamping or releasing of the plungers, the clamping device has a clamping unit operable by the actuation device and movable in a limited path between a release position and a clamping position, and the clamping unit is horizontally guided on the support construction, when in the clamping position, the clamping unit is engaged with the plungers by one mechanism selected from the list consisting of: clamping pressure and frictional pressure.

* * * * *